US010538411B2

(12) United States Patent
Yamamoto

(10) Patent No.: US 10,538,411 B2
(45) Date of Patent: Jan. 21, 2020

(54) SHEET CONVEYING DEVICE

(71) Applicant: CANON KABUSHIKI KAISHA, Tokyo (JP)

(72) Inventor: Daisuke Yamamoto, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/540,985

(22) Filed: Nov. 13, 2014

(65) Prior Publication Data

US 2015/0137443 A1 May 21, 2015

(30) Foreign Application Priority Data

Nov. 19, 2013 (JP) ..... 2013-239229

(51) Int. Cl.
*B65H 85/00* (2006.01)

(52) U.S. Cl.
CPC ..... *B65H 85/00* (2013.01)

(58) Field of Classification Search
CPC ..... B65H 15/00; B65H 2301/16; B65H 2301/332; B65H 2301/333; B65H 2301/4211; B65H 2404/651; B65H 29/58; B65H 85/00; B65H 2404/143; B65H 2301/3332; B65H 29/60; B65H 31/00
USPC ..... 271/65, 186, 184, 185, 224, 225, 902, 271/314, 303, 272, 273, 274, 207
See application file for complete search history.

(56) References Cited

U.S. PATENT DOCUMENTS 4,171,106 A * 10/1979 Crouse ..... B65H 18/20 242/534.2
4,729,557 A * 3/1988 Kiyohara ..... B41J 11/02 271/264
5,360,180 A * 11/1994 Welp ..... B65H 18/16 242/530.4
6,446,956 B1 * 9/2002 Sato ..... B41J 11/703 271/176
6,719,283 B2 * 4/2004 Tsuchiya ..... B65H 29/12 270/58.07
6,769,682 B2 * 8/2004 Sumi et al. ..... 271/186
7,431,293 B2 * 10/2008 Carter et al. ..... 271/303
7,762,552 B2 * 7/2010 Guerand et al. ..... 271/303
7,764,920 B2 * 7/2010 Lin ..... G03G 15/602 399/364
8,047,544 B2 * 11/2011 Sekino ..... 271/303
8,256,769 B2 * 9/2012 Takahira et al. ..... 271/272
2003/0071409 A1 * 4/2003 Sumi ..... B65H 5/36 271/186

(Continued)

FOREIGN PATENT DOCUMENTS

JP 2000-026002 A 1/2000
JP 2001335216 A 12/2001

(Continued)

*Primary Examiner* — Thomas A Morrison
(74) *Attorney, Agent, or Firm* — Canon USA, Inc., IP Division

(57) ABSTRACT

In a cross section perpendicular to an axial direction of a discharge roller, a rotation center of the discharge roller is provided at a position out of a straight line that connects a rotation center of a discharge driven roller and a rotation center of a duplex driven roller. The discharge roller that receives forces from the discharge driven roller and the duplex driven roller is held by a discharge roller presser.

10 Claims, 8 Drawing Sheets

(56) References Cited

U.S. PATENT DOCUMENTS

| | | | | |
|---|---|---|---|---|
| 2007/0000966 | A1* | 1/2007 | Tsusaka | B41J 13/03 226/101 |
| 2008/0224385 | A1* | 9/2008 | Takahira | B65H 5/062 271/225 |
| 2009/0295061 | A1* | 12/2009 | Honda | B41J 13/0036 271/3.14 |

FOREIGN PATENT DOCUMENTS

| | | | |
|---|---|---|---|
| JP | 2006-151588 | * | 6/2006 |
| JP | 2006232443 | A | 9/2006 |
| JP | 2007084182 | A | 4/2007 |

* cited by examiner

SHEET CONVEYING DEVICE

BACKGROUND

Field

The present disclosure relates to a sheet conveying device.

Description of the Related Art

Image forming apparatuses, such as a copying machine, a printer, and a facsimile, have been required to have smaller size and higher speed of duplex printing on sheets.

In a typical method for performing printing (image formation) on both surfaces of a sheet, after one surface of the sheet is printed, the sheet is conveyed to a duplex conveying path by rotating rollers nipping the sheet backward. By conveying the sheet to a transfer part and a fixing part in an inverted state, the other unprinted surface is printed. At this time, the rollers rotating backward are provided in two ways, that is, they are provided on a discharging path for single sheet surface feeding, or on a conveying path used only during duplex printing. In the former case, however, until the rollers rotate backward and the sheet comes out of the nip, the next sheet cannot be conveyed. This is disadvantageous for speedup. Further, in the latter case, two pairs of rollers are necessary, and this disadvantageous for size reduction.

Accordingly, in an image forming apparatus described in Japanese Patent Laid-Open No. 2000-26002, two driven rollers are opposed to one discharge roller (so-called triple roller structure) to form two nips. This achieves both speedup and size reduction.

However, in the structure described in Japanese Patent Laid-Open No. 2000-26002, the rotation centers of the triple rollers (driving roller and two driven rollers) are disposed on one straight line. Hence, when the driving roller rotates forward and backward, the direction of force changes, and the driving roller and the driven rollers sometimes shake in the sheet conveying direction and the up-down direction. When the rollers shake, conveyance of the sheet becomes unstable. This may cause a jam in some cases.

SUMMARY

A sheet conveying device comprising: a driving roller rotated by driving force received from a driving source; a first roller provided at a position opposed to the driving roller to rotate together with the driving roller; a second roller provided at a position opposed to the driving roller to rotate together with the driving roller; a first biasing portion configured to bias the first roller toward the driving roller; a second biasing portion configured to bias the second roller toward the driving roller; and a restricting portion configured to restrict the driving roller from being moved by forces received from the first roller biased by the first urging portion and the second roller biased by the second urging portion, in a cross section perpendicular to a rotation axial direction of the driving roller, and wherein, in the cross section perpendicular to the rotation axial direction of the driving roller, a rotation center of the driving roller is provided at a position out of a straight line that connects a rotation center of the first roller and a rotation center of the second roller.

Further features of the present disclosure will become apparent from the following description of exemplary embodiments with reference to the attached drawings.

DESCRIPTION OF THE EMBODIMENTS

First Embodiment

Description of Overall Configuration of Image Forming Apparatus 100

A first embodiment to which the present disclosure is applied will be described below with reference to the drawings.

First, a description will be given of the configuration and an image forming process of an image forming apparatus 100 serving as a laser beam printer with reference to FIG. 1.

Figure 1:
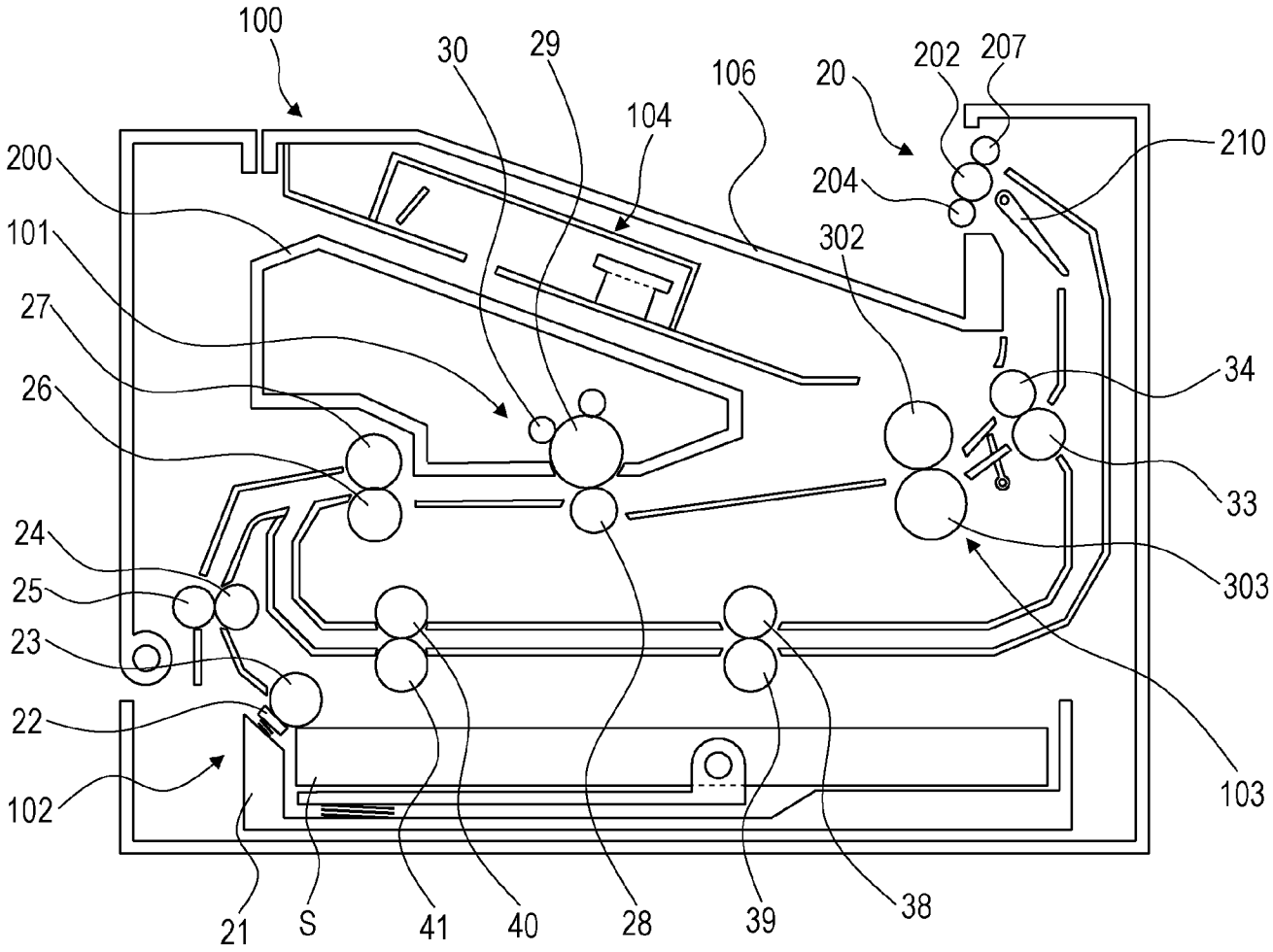
FIG. 1 is a cross-sectional view of an image forming apparatus according to a first embodiment.

FIG. 1 is a schematic cross-sectional view of the image forming apparatus 100. As illustrated in FIG. 1, the image forming apparatus 100 includes an image forming unit 101, a feeding unit 102, a laser scanner unit 104, a fixing unit 103, an inverting unit 20, a discharge tray (stack portion) 106.

The feeding unit 102 includes a feeding cassette 21, a separating pad 22, and a feeding roller 23. Stacked sheets S are fed by the feeding roller 23, and are separated and fed out one by one by the separating pad 22. After that, a fed sheet S is conveyed further downstream in the conveying direction by a feeding and conveying roller pair formed by a feeding and conveying roller 24 and a feeding and conveying idler roller 25 provided on the downstream side. The feeding unit 102 further includes a registration roller pair formed by a registration roller 26 and a registration idler roller 27 that temporarily stop the sheet S to align the sheet S and a toner image. The sheet S conveyed by the feeding and conveying roller pair is positioned and timed by the registration roller pair, and is then conveyed to the image forming unit 101.

The image forming unit 101 includes a process cartridge 200 removably mounted in a body of the image forming apparatus 100 (apparatus body). Within the process cartridge 200, a photoconductive drum 29 serving as an image bearing member is provided. The image forming unit 101 further includes a transfer roller 28 disposed opposed to the photoconductive drum 29. In response to a print command, laser light is applied from the laser scanner unit 104 onto a uniformly charged surface of the photoconductive drum 29 according to image information to form an electrostatic latent image on the surface of the photoconductive drum 29. By developing the electrostatic latent image by a developing device 30, a toner image is formed on the surface of the photoconductive drum 29. The toner image formed on the surface of the photoconductive drum 29 is transferred onto the sheet S that is conveyed by the registration roller pair to a nip between the photoconductive drum 29 and the transfer roller 28. After transfer of the image, the sheet S is conveyed to the fixing unit 103.

The fixing unit 103 includes a heating roller 302, a pressure roller 303 in pressing contact with the heating roller 302, a fixing conveying roller 33, and a fixing conveying idler roller 34. The sheet S conveyed to the fixing unit 103 is guided to a nip between the heating roller 302 and the pressure roller 303 in contact with each other in the fixing unit 103. At this time, the toner image is fixed on the sheet S by heating and pressurization. After that, the sheet S is carried by a fixing conveying roller pair formed by the fixing conveying roller 33 and the fixing conveying idler roller 34, and is conveyed to the inverting unit 20.

The inverting unit 20 includes triple rollers of a discharge roller (driving roller) 202 serving as a first roller, discharge driven rollers (first driven roller) 204 serving as a second roller, and duplex driven rollers (second driven roller) 207, and a flapper (switch portion) 210 movable to switch the conveying path. The triple rollers have the functions of discharging the sheet S and inverting the sheet S, and select discharging operation or inverting operation in response to a print command. To be discharged from the apparatus body 100, the sheet S is discharged and put on the discharge tray 106. When the sheet S is to be inverted, the conveying direction of the sheet S is reversed at a predetermined timing, and the sheet S is conveyed to an inverting conveying path. After that, the sheet S is refed by a duplex conveying roller pair formed by a duplex conveying roller 39 and a duplex conveying idler roller 38, and a refeeding roller pair formed by a refeeding roller 41 and a refeeding idler roller 40. While the refed sheet S passes through the image forming unit 101 and the fixing unit 103, a second surface thereof is printed, similarly to the first surface. After the second surface is printed, the sheet S is discharged and put on the discharge tray 106 by the inverting unit 20.

Description of Inverting Unit 20 for Discharging and Inverting Sheet S

Figure 2:
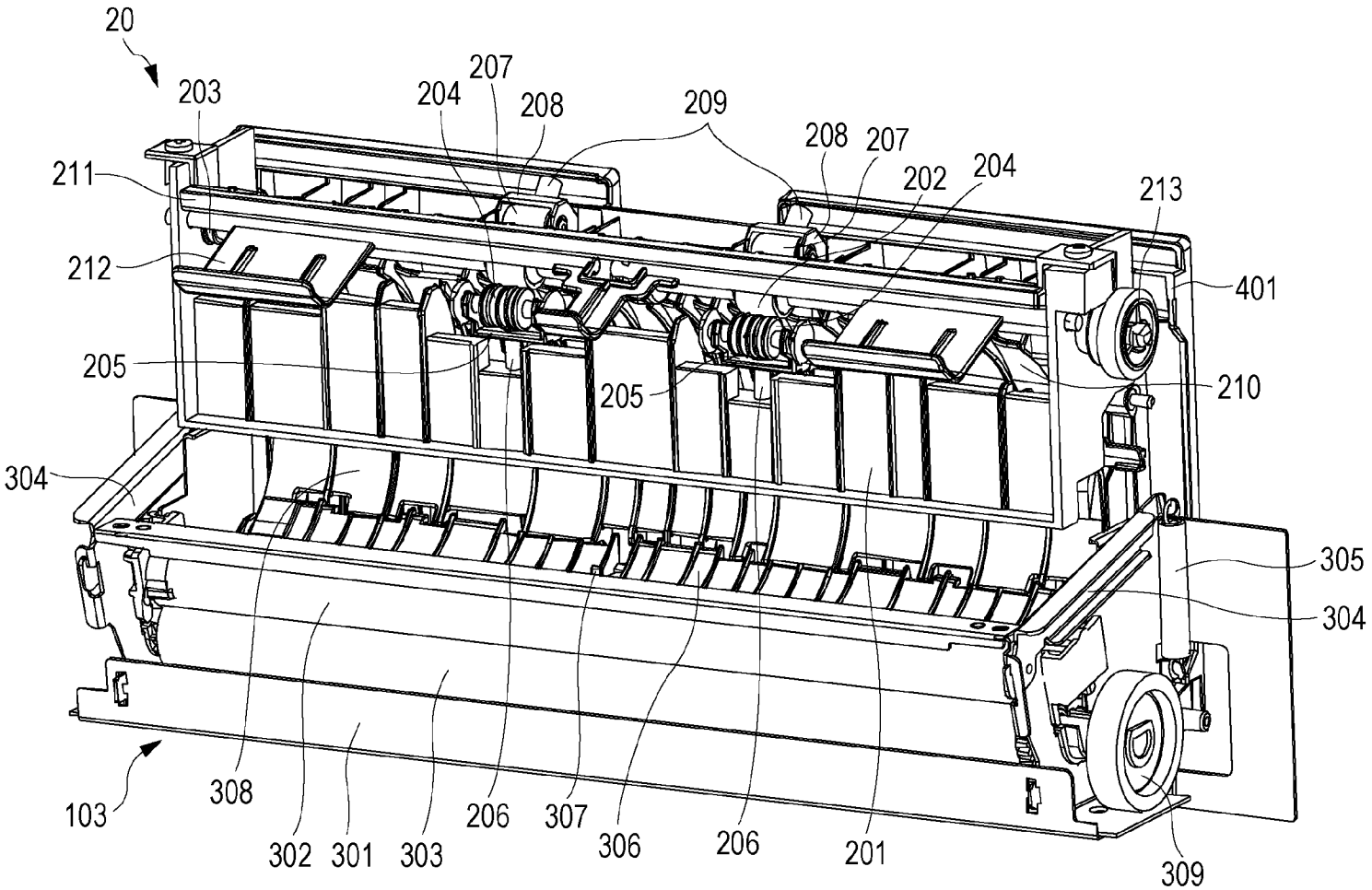
FIG. 2 is a perspective view of an inverting unit in the first embodiment.

Next, the inverting unit 20 of the image forming apparatus 100 will be described. FIG. 2 is a perspective view of the inverting unit 20. As illustrated in FIG. 2, the inverting unit 20 includes a discharge frame 201, a discharge roller 202, discharge roller bearings 203, discharge driven rollers 204, discharge driven roller holders 205, and discharge pressurizing springs (first biasing portion) 206. The discharge driven rollers 204 are held by the discharge driven roller holders 205, and are biased toward the discharge roller 202 by the discharge pressurizing springs 206.

The inverting unit 20 further includes duplex driven rollers 207, duplex driven roller holders 208, and duplex pressurizing springs (second biasing portion) 209. The duplex driven rollers 207 are held by the duplex driven roller holders 208, and are biased toward the discharge roller 202 by the duplex pressurizing springs 209. The inverting unit 20 further includes flappers 210 for switching the conveyance path between the discharging path and the duplex printing path, a discharge roller presser (pressing portion) 211, and full-load detection flags 212.

As illustrated in FIG. 2, the fixing unit 103 is provided upstream of the inverting unit 20. The fixing unit 103 includes a fixing frame 301, a heating roller 302, a pressure roller 303, pressure members 304, fixing pressurizing springs 305, a fixing guide 306, a fixing sensor 307, and a fixing duplex guide 308. The fixing unit 103 further includes a fixing gear 309 for transmitting driving to the pressure roller 303. A duplex guide 401 guides a sheet S at the time of inversion.

The discharge roller 202 is rotated by driving force generated by a motor M (driving source) and transmitted from a discharge roller gear 213. The discharge driven rollers 204 and the duplex driven rollers 207 are rotated along with the rotation of the discharge roller 202.

Figure 9:
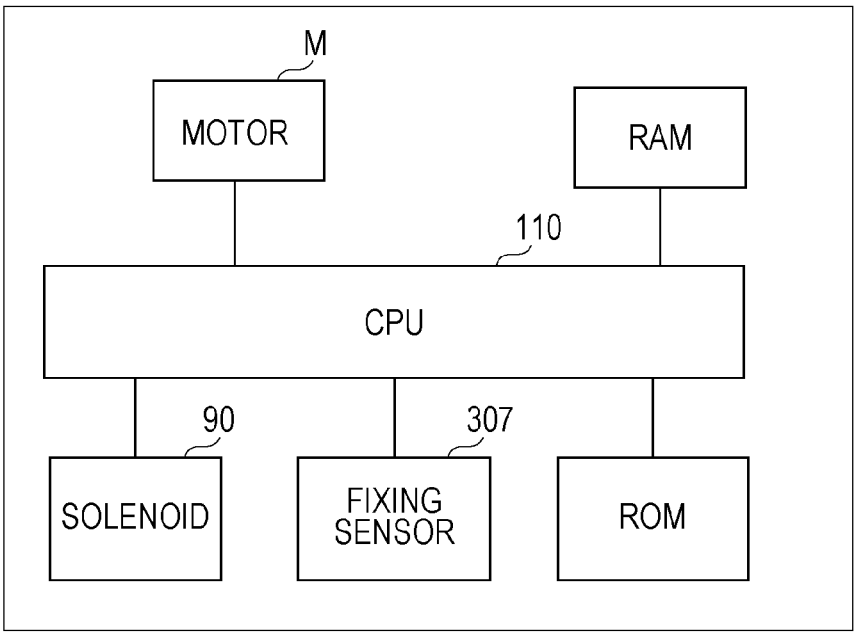
FIG. 9 is a block diagram of the first embodiment.

The discharge roller 202 is rotated by the driving force generated by the motor M, and the rotating direction thereof (forward rotation or backward rotation) is determined in accordance with the driven train switched by a solenoid 90. FIG. 9 is a block diagram of the first embodiment. As illustrated in FIG. 9, a CPU 110 is coupled to the motor M, the solenoid 90, and the fixing sensor 307. The CPU 110 is also coupled o a ROM and a RAM, and executes a program stored in the ROM by using the RAM as a work memory. In the first embodiment, the CPU 110, the ROM, and the RAM constitute a control unit. The control unit controls the solenoid 90 to switch the drive train for transmitting the driving force from the motor M to the discharge roller 202.

The discharge driven rollers 204 are provided below the discharge roller 202, and are pressed against the discharge roller 202 by the discharge pressurizing springs 206. The discharge driven rollers 204 and the discharge roller 202 form nips, and the discharge driven rollers 204 are rotated along with the rotation of the discharge roller 202. When the sheet S is discharged to the discharge tray 106, the discharge driven rollers 204 are rotated along with the discharge roller 202 rotating forward.

The duplex driven rollers 207 are provided above the discharge roller 202, and are pressed against the discharge roller 202 by the duplex pressurizing springs 209. The duplex driven rollers 207 and the discharge roller 202 form nips, and the duplex driven rollers 207 are rotated along with the rotation of the discharge roller 202. When the sheet S is conveyed to the image forming unit 101 again, the duplex driven rollers 207 are rotated along with the discharge roller 202 rotating forward after backward rotation.

Figure 3:
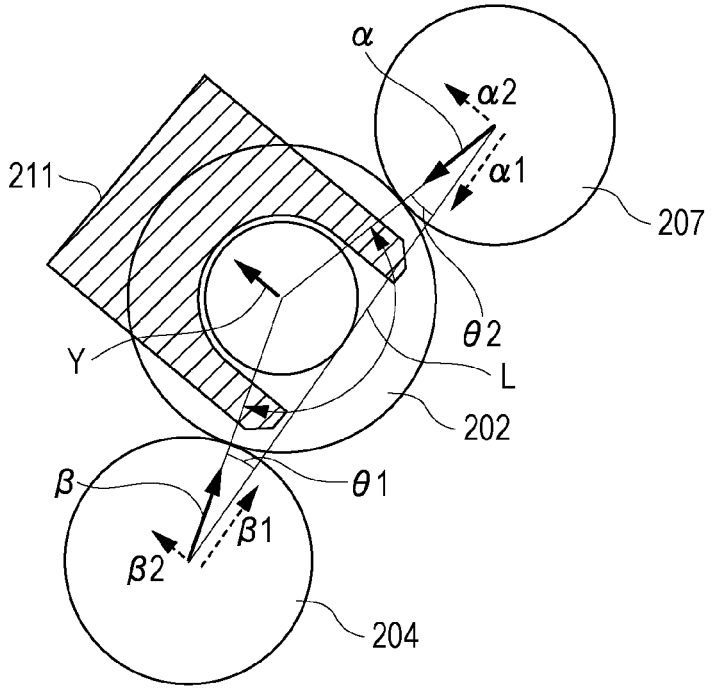
FIG. 3 is a cross-sectional view illustrating the force relationship among a discharge roller, a discharge driven roller, and a duplex driven roller.

FIG. 3 is a cross-sectional view illustrating the force relationship among the discharge roller 202, the discharge driven rollers 204, and the duplex driven rollers 207. In a cross section perpendicular to the rotation axial direction of the discharge roller 202, the rotation center of the discharge roller 202 is provided at a position out of a straight line L that connects the rotation center of each discharge driven roller 204 and the rotation center of each duplex driven roller 207. The discharge roller presser 211 for holding the discharge roller 202 is provided on a side of the straight line L where the rotation center of the discharge roller 202 is provided (upper left side in FIG. 3). That is, the discharge roller presser 211 is provided on a side of the rotation center of the discharge roller 202 opposite from the straight line L.

The force relationship of the discharge roller presser 211 is as shown in FIG. 3. Resultant force produced from the discharge driven roller 204 and the duplex driven roller 207 goes toward the discharge roller presser 211. That is, a resultant force $\gamma$ of the duplex driven roller 207 biased in a direction of arrow $\alpha$ and the discharge driven roller 204 biased in a direction of arrow $\beta$ acts toward the discharge roller presser 211. Therefore, according to the first embodiment, since the discharge roller 202, the discharge driven roller 204, and the duplex driven roller 207 are fixed (rarely shake) by the discharge roller presser 211, the sheet S can be stably conveyed.

The biasing force $\alpha$ from the duplex driven roller 207 to the discharge roller 202 is divided into a force component $\alpha 1$ (going in the same direction as the straight line L) and a force component $\alpha 2$ (going in the direction perpendicular to the straight line L). The urging force $\beta$ from the discharge driven roller 204 to the discharge roller 202 is divided into force components $\beta 1$ and $\beta 2$. Here, $\alpha 1$ and $\beta 1$ and $\alpha 2$ and $\beta 2$ do not always need to be equal. Preferably, the rotation center of the discharge roller 202 is disposed such that an angle θ1 formed by the straight line L and β and an angle θ2 formed by the straight line L and α are within the range of about 5 to 10 degrees.

Figure 4:
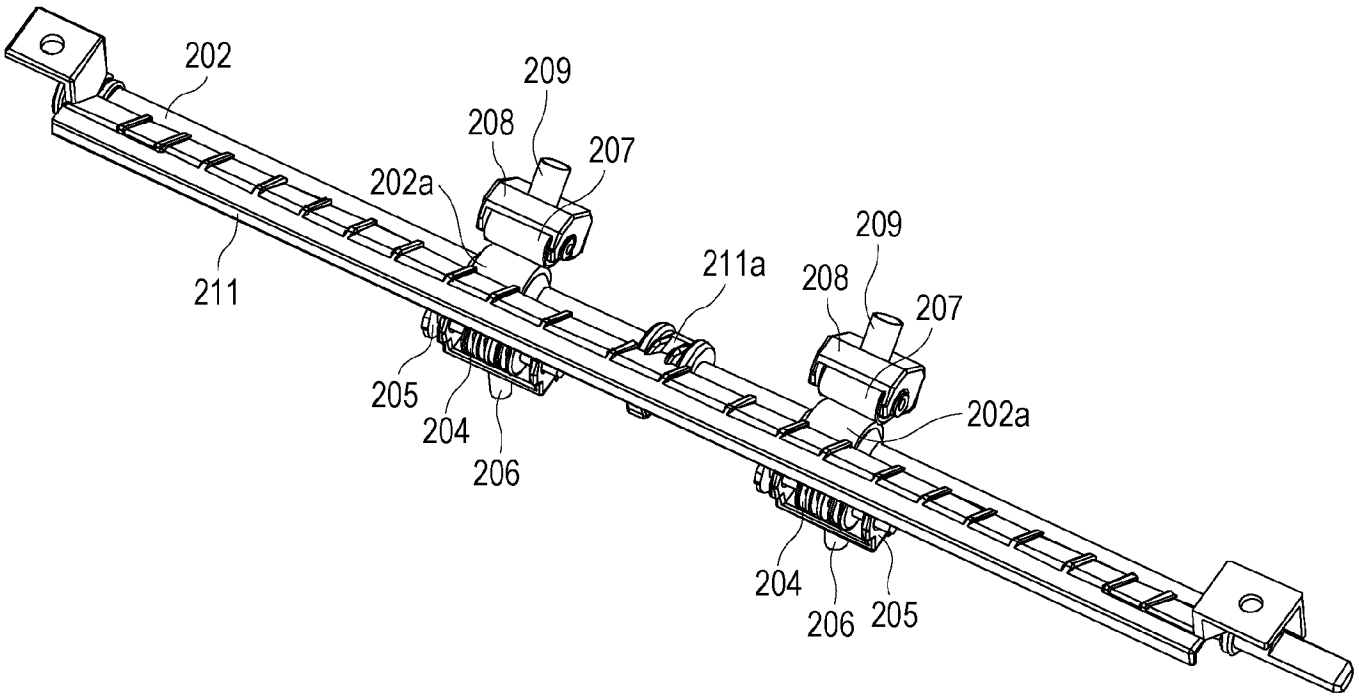
FIG. 4 is a perspective view of the inverting unit in the first embodiment.

FIG. 4 is a perspective view of the inverting unit 20. As illustrated in FIG. 4, the discharge roller 202 has a plurality of rubber roller portions 202*a* separated in the rotation axial direction. A slide holding portion 211*a* serving as a part of the discharge roller presser 211 is provided between the rubber roller portions 202*a* to hold the rotation shaft of the discharge roller 202.

Figure 5:
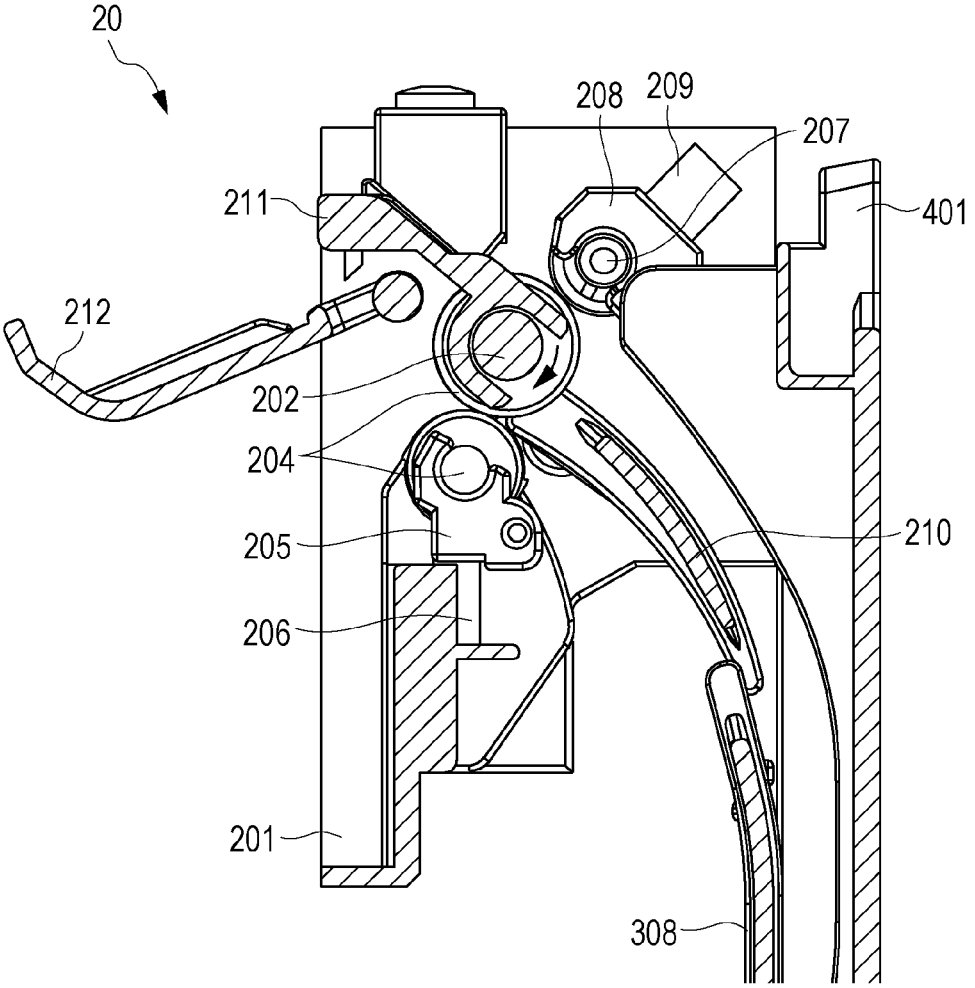
FIG. 5 is a cross-sectional view of the inverting unit in the first embodiment.
Figure 6:
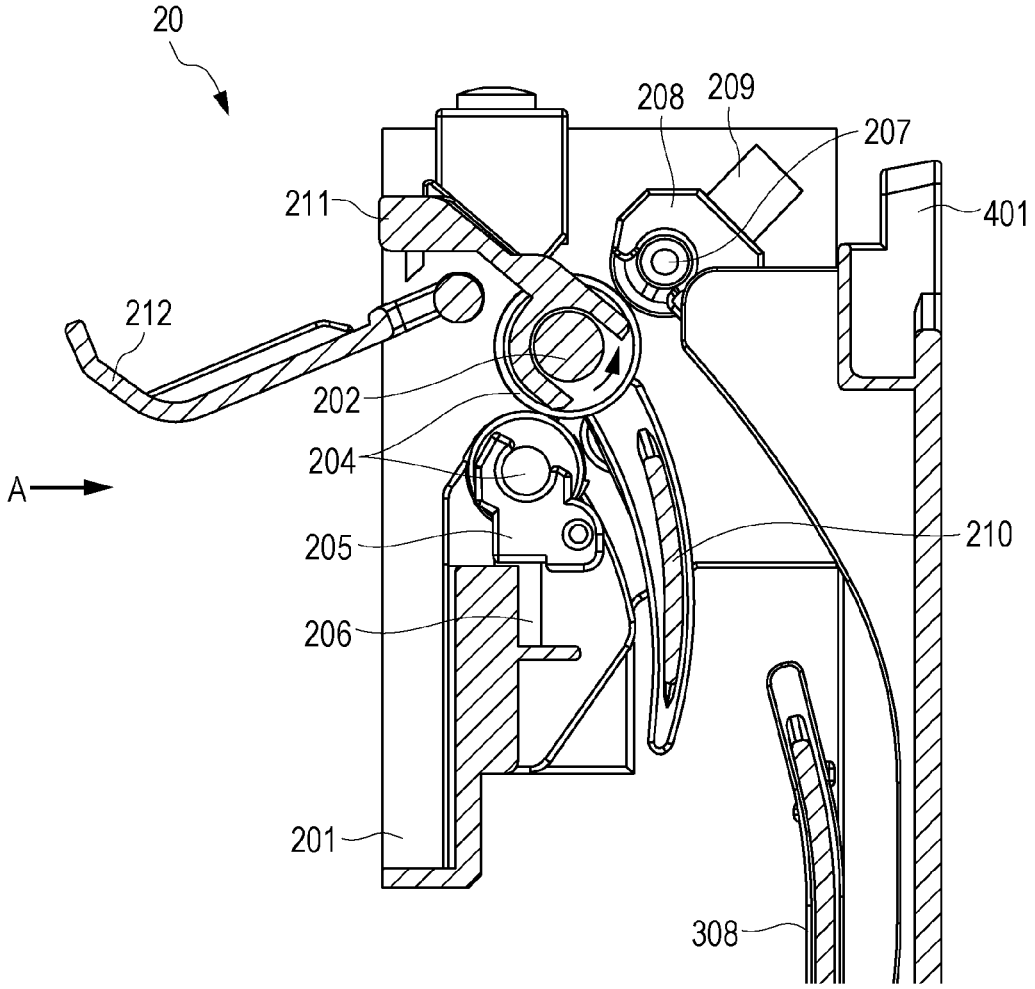
FIG. 6 is a cross-sectional view of the inverting unit in the first embodiment.

FIGS. 5 and 6 are cross-sectional views of the inverting unit 20. As illustrated in FIGS. 5 and 6, in the first embodiment, the discharge roller presser 211 holds the full-load detection flags 212 that form a part of a conveyance guide for guiding the sheet S and detects full-load of sheets S on the discharge tray 106.

To discharge a sheet S onto the discharge tray 106, as illustrated in FIG. 5, the discharge roller 202 rotates clockwise, and the flappers 210 are positioned at an upper position (first position). To invert a sheet S for duplex printing after the first surface thereof is printed, when the fixing sensor 307 detects a leading edge of the sheet S, the rotating direction of the discharge roller 202 is switched to the counterclockwise direction by the solenoid 90, and the flappers 210 move to a lower position (second position), as illustrated in FIG. 6.

Figure 7A:
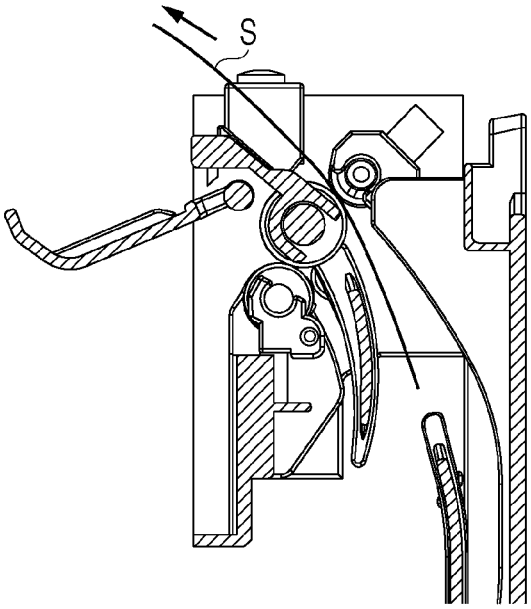
FIGS. 7A to 7C are cross-sectional views illustrating the behavior of a sheet in the first embodiment.
Figure 7B:
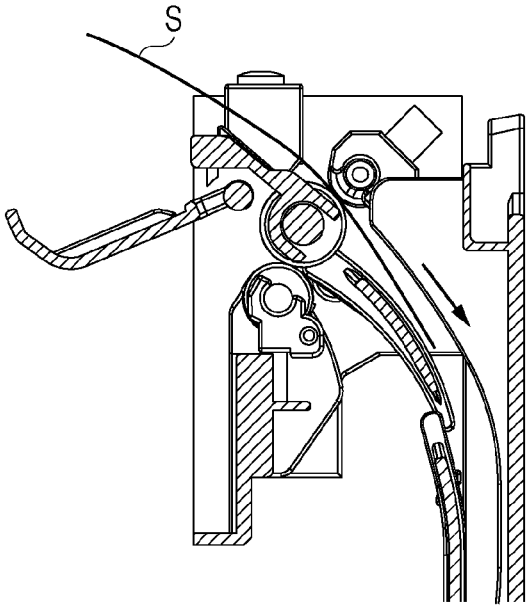
Figure 7C:
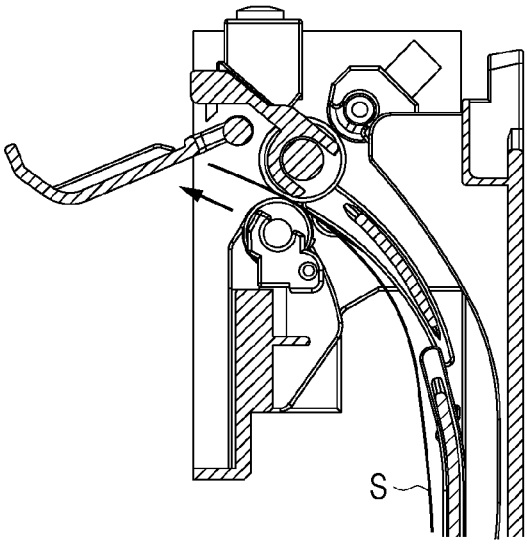

FIGS. 7A to 7C are cross-sectional views illustrating the behavior of the sheet S. After passing through the fixing unit 103, the sheet S is conveyed along the fixing duplex guide 308, and is conveyed to the nips between the discharge roller 202 and the duplex driven rollers 207 because the flappers 210 are located at the lower position (FIG. 7A). At this time, when the fixing sensor 307 detects that a trailing edge of the sheet S has come out of the fixing duplex guide 308, the rotating direction of the discharge roller 202 is switched to the clockwise direction, and the flappers 210 move to the upper position (FIG. 7B).

After that, the sheet S is conveyed to the duplex conveying path by the discharge roller 202 and the duplex driven rollers 207. The sheet S conveyed to the duplex conveying path passes through the image forming unit 101 and the fixing unit 103 again, where the second surface thereof is printed. Then, the sheet S is conveyed to the nips between the discharge roller 202 and the discharge driven rollers 204, as illustrated in FIG. 7C, and is discharged onto the discharge tray 106.

While the present disclosure is applied to the inverting unit 20 in the above-described first embodiment, the disclosure should not be limited thereto. In the sheet conveying device, the present disclosure may be used in a portion different from the inverting unit.

While the rotation center of the discharge roller 202 is provided on the downstream side (left upper side in FIG. 3) of the straight line L in the discharging direction in the above-described first embodiment, the present disclosure should not be limited thereto. That is, the direction in which the resultant force of the discharge driven rollers 204 and the duplex driven rollers 207 occurs may be on the upstream side (lower right side in FIG. 3) in the discharging direction, and the discharge roller 202 for receiving the resultant force may be held by the discharge roller presser 211. From the viewpoint of size reduction of the apparatus body, it is preferable that the discharge roller presser 211 should be provided on the downstream side of the straight line L in the discharging direction, as in the first embodiment.

While the slide holding portion 211*a* of the discharge roller presser 211 is disposed between (on the inner side in the axial direction) the rubber roller portions 202*a* in the above-described first embodiment, the present disclosure should not be limited thereto. That is, the slide holding portion 211*a* may be disposed near and on the outer side of the rubber roller portions 202*a*. From the viewpoint of shake prevention of the rollers, it is preferable that the slide holding portion 211*a* should be disposed between the rubber roller portions 202*a*, as in the first embodiment. A plurality of slide holding portions 211*a* may be provided in the axial direction of the discharge roller 202.

Figure 8:
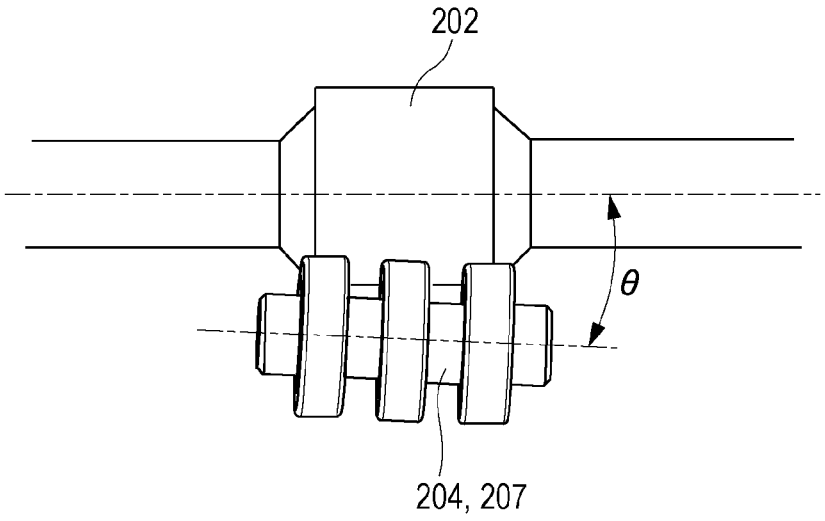
FIG. 8 illustrates a modification of the first embodiment.

FIG. 8 illustrates a modification of the first embodiment, as viewed from a direction of arrow A in FIG. 6. As illustrated in FIG. 8, in the present disclosure, the discharge driven rollers 204 and the duplex driven rollers 207 may be disposed at an angle θ (obliquely) to the discharge roller 202 in the axial direction of the discharge roller 202.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2013-239229, filed Nov. 19, 2013, which is hereby incorporated by reference herein in its entirety.

What is claimed is:

1. A sheet conveying device comprising:

a roller unit configured to convey a sheet in a first nip and a second nip, the roller unit including a driving roller, a shaft configured to be rotated with the driving roller by driving force received from a driving source, a first roller configured to form the first nip with the driving roller and configured to be rotated by a rotation of the driving roller, and a second roller configured to form the second nip with the driving roller and configured to be rotated by the rotation of the driving roller, wherein a force that the second roller asserts on the driving roller along a virtual straight line between a rotation center of the second roller and a rotation center of the driving roller is larger than a force that the second roller asserts on the driving roller along a virtual straight line between the rotation center of the second roller and a rotation center of the first roller, a holding member including a concave holding portion configured to hold the shaft using the force that the second roller asserts on the driving roller, a frame supporting both longitudinal end portions of the holding member, the holding portion of the holding member being provided between both the longitudinal end portions of the holding member in an axial direction of the shaft, and a switch member configured to switch a conveying path of the sheet, the switch member being movable between a first position to guide the sheet to the first nip and a second position to guide the sheet to the second nip.

2. The sheet conveying device according to claim 1, wherein the holding member including a conveyance guide surface guides a sheet conveyed by the driving roller.

3. The sheet conveying device according to claim 1, wherein the driving roller is rotatable in a forward direction and in a backward direction, by the driving force received from the driving source.

4. The sheet conveying device according to claim 1, wherein, in a cross section perpendicular to the axial direction of the shaft, the holding member is provided downstream of the virtual straight line passing the rotation center of the first roller and the rotation center of the second roller in a conveyance direction of the sheet.

5. The conveying device according to claim 3, further comprising:

an image forming unit configured to form an image on a sheet, wherein the sheet on which the image has been formed by the image forming unit is discharged by a conveying in the first nip while the driving roller is rotating in the forward direction, and wherein the sheet on which the image has been formed on a first surface of the sheet by the image forming unit is conveyed to the image forming unit again by a conveying in the second nip while the driving roller rotating is rotating in the forward direction after rotating in the backward direction.

6. The sheet conveying device according to claim 1, wherein in a cross section perpendicular to the axial direction of the shaft, the rotation center of the driving roller is provided downstream of the virtual straight line passing the rotation center of the first roller and the rotation center of the second roller in a conveyance direction of the sheet at the first nip, and wherein the holding portion of the holding member holds the shaft from a direction opposite to the conveyance direction of the sheet to restrict the driving roller from being moved by forces received from the first roller and the second roller.

7. The sheet conveying device according to claim 6, wherein an angle formed by the virtual straight line passing the rotation center of the first roller and the rotation center of the second roller and a virtual straight line passing the rotation center of the driving roller and the rotation center of the first roller is within a range of 5 to 10 degrees.

8. The sheet conveying device according to claim 1, wherein, in a cross section perpendicular to the axial direction of the shaft, the holding portion has a curved surface facing a circumferential surface of the shaft and extending along a circumferential direction of the shaft.

9. The sheet conveying device according to claim 1, wherein a force that the first roller asserts on the driving roller along the virtual straight line between the rotation center of the first roller and the rotation center of the driving roller is larger than a force that the first roller asserts on the driving roller along a virtual straight line between the rotation center of the second roller and the rotation center of the first roller, and wherein the concave holding portion is configured to hold the shaft using a resultant force comprising a sum of the force that the second roller asserts on the driving roller and the force that the first roller asserts on the driving roller.

10. The sheet conveying device according to claim 1, wherein the driving roller includes a plurality of roller portions provided on the rotation shaft, and wherein the holding portion is disposed between the plurality of roller portions in the axial direction of the shaft.

* * * * *